US008180094B2

(12) United States Patent
Harvey

(10) Patent No.: US 8,180,094 B2
(45) **Date of Patent: *May 15, 2012**

(54) EARPIECE WITH ACOUSTIC VENT FOR DRIVER RESPONSE OPTIMIZATION

(75) Inventor: Jerry J. Harvey, Lake Ozark, MO (US)

(73) Assignee: Logitech International, S.A. (CH)

( * ) Notice: Subject to any disclaimer, the term of this patent is extended or adjusted under 35 U.S.C. 154(b) by 827 days.

This patent is subject to a terminal disclaimer.

(21) Appl. No.: 12/286,846

(22) Filed: Oct. 2, 2008

(65) Prior Publication Data

US 2009/0041262 A1 Feb. 12, 2009

Related U.S. Application Data

(63) Continuation of application No. 11/487,856, filed on Jul. 17, 2006, now Pat. No. 7,489,794.

(60) Provisional application No. 60/715,001, filed on Sep. 7, 2005.

(51) Int. Cl.
*H04R 25/00* (2006.01)

(52) U.S. Cl. ..... 381/380; 381/322; 381/328

(58) Field of Classification Search ..... 381/322, 381/324, 325, 328, 337, 338, 346, 349, 351, 381/373, 380, 382; 181/129, 130, 135, 160
See application file for complete search history.

(56) References Cited

U.S. PATENT DOCUMENTS

| | | | | |
|---|---|---|---|---|
| 2,430,229 | A * | 11/1947 | Kelsey | 381/338 |
| 3,671,685 | A * | 6/1972 | McCabe | 381/382 |
| 4,800,982 | A | 1/1989 | Carlson | |
| 4,815,560 | A | 3/1989 | Madaffari | |
| 4,867,267 | A | 9/1989 | Carlson | |
| 5,068,901 | A | 11/1991 | Carlson | |
| 5,887,070 | A * | 3/1999 | Iseberg et al. | 381/380 |
| 7,634,099 | B2 * | 12/2009 | Harvey et al. | 381/380 |

* cited by examiner

*Primary Examiner* — Huyen D Le
(74) *Attorney, Agent, or Firm* — Patent Law Office of David G. Beck

(57) ABSTRACT

An acoustically tuned earpiece is provided. Venting is performed by boring a control port, separate from the output port, into the driver. The diameter of the control port must be sufficiently small to restrict the flow of air into and out of the driver, thus isolating the acoustic performance of the driver from the volume and/or the sealing capabilities of the earpiece enclosure. The exact size of the venting port is selected to achieve the desired acoustic performance. In all cases, the control port has a cross-sectional area that is less than 25 percent of the cross-sectional area of the driver's output port. In order to optimize the size of the control port, an iterative process is preferably used in which the cross-sectional area of the control port is gradually increased while monitoring the performance of the driver compared to a target response.

19 Claims, 6 Drawing Sheets

EARPIECE WITH ACOUSTIC VENT FOR DRIVER RESPONSE OPTIMIZATION

CROSS-REFERENCES TO RELATED APPLICATIONS

This application is a continuation of U.S. patent application Ser. No. 11/487,856, filed Jul. 17, 2006 now U.S. Pat. No. 7,489,794, which claims the benefit of U.S. Provisional Patent Application Ser. No. 60/715,001, filed Sep. 7, 2005, the disclosures of which are incorporated herein by reference for any and all purposes.

FIELD OF THE INVENTION

The present invention relates generally to audio monitors and, more particularly, to in-ear monitors.

BACKGROUND OF THE INVENTION

Earpieces, also referred to as in-ear monitors and canal phones, are commonly used to listen to both recorded and live music. A typical recorded music application would involve plugging the earpiece into a music player such as a CD player, flash or hard drive based MP3 player, home stereo, or similar device using the earpiece's headphone jack. Alternately, the earpiece can be wirelessly coupled to the music player. In a typical live music application, an on-stage musician wears the earpiece in order to hear his or her own music during a performance. In this case, the earpiece is either plugged into a wireless belt pack receiver or directly connected to an audio distribution device such as a mixer or a headphone amplifier. This type of monitor offers numerous advantages over the use of stage loudspeakers, including improved gain-before-feedback, minimization/elimination of room/stage acoustic effects, cleaner mix through the minimization of stage noise, increased mobility for the musician and the reduction of ambient sounds.

Earpieces are quite small and are normally worn just outside the ear canal. As a result, the acoustic design of the monitor must lend itself to a very compact design utilizing small components. Some monitors are custom fit (i.e., custom molded) while others use a generic "one-size-fits-all" eartip.

Earpieces use either one or more diaphragm-based drivers, one or more armature-based drivers, or a combination of both driver types. Broadly characterized, a diaphragm is a moving-coil speaker with a paper or Mylar diaphragm. Since the cost to manufacture diaphragms is relatively low, they are widely used in many common audio products (e.g., ear buds). In contrast to the diaphragm approach, an armature receiver utilizes a piston design. Due to the inherent cost of armature receivers they are typically only found in hearing aids and high-end in-ear monitors.

Armature drivers, also referred to as balanced armatures, were originally developed by the hearing aid industry. This type of driver uses a magnetically balanced shaft or armature within a small, typically rectangular, enclosure. A single armature is capable of accurately reproducing low-frequency audio or high-frequency audio, but incapable of providing high-fidelity performance across all frequencies. To overcome this limitation, armature-based earpieces often use two, or even three, armature drivers. In such multiple armature arrangements, a crossover network is used to divide the frequency spectrum into multiple regions, i.e., low and high or low, medium, and high. Separate armature drivers are then used for each region, individual armature drivers being optimized for each region. In contrast to the multiple driver approach often used with armature drivers, earpieces utilizing diaphragm drivers are typically limited to a single diaphragm due to the size of the diaphragm assembly. Unfortunately, as diaphragm-based monitors have significant frequency roll off above 4 kHz, an earpiece with a single diaphragm cannot achieve the desired upper frequency response while still providing an accurate low frequency response.

In order to obtain the best possible performance from an earpiece, the driver or drivers within the earpiece are tuned. Armature tuning is typically accomplished through the use of acoustic filters (i.e., dampers). Further armature tuning can be achieved by porting, or venting, the armature enclosure. Typically, the driver is vented to a sealed, controlled volume. Diaphragm drivers, due to the use of a moving-coil speaker, are generally tuned by controlling the dimensions of the diaphragm housing. Depending upon the desired frequency response, the diaphragm housing may or may not be ported.

Although porting (i.e., venting) a driver to a controlled volume allows the acoustic performance of an earpiece to be tuned, it places relatively tight manufacturing tolerances on the controlled volume of the earpiece, thus adding to the cost associated with fabricating such high fidelity earpieces. Accordingly, what is needed in the art is an earpiece that can achieve the acoustic performance provided by porting to a controlled volume without the added manufacturing complexity and cost. The present invention provides such an earpiece.

SUMMARY OF THE INVENTION

The present invention provides an earpiece that is acoustically tuned using at least one vented driver. Venting is performed by boring a control port, separate from the output port, into the driver. The diameter of the control port must be sufficiently small to restrict the flow of air into and out of the driver, thus isolating the acoustic performance of the driver from the volume and/or the sealing capabilities of the earpiece enclosure. The exact size of the control port is selected to achieve the desired acoustic performance. In all cases, the control port has a cross-sectional area that is less than 25 percent of the cross-sectional area of the driver's output port. In at least one preferred embodiment, the control port has a diameter of approximately 0.20 millimeters, preferably with a tolerance of ±0.03 millimeters.

In order to optimize the size of the control port, for example during the design of a new earpiece, an iterative process is preferably used. During this process the driver is characterized, enlarged, and then re-characterized. The driver characterizations before and after control port enlargement are compared to a target driver response. If the pre-enlargement control port provides better performance, relative to the target response, then the pre-enlargement control port diameter is selected as the optimized control port size. If the post-enlargement control port provides better performance, relative to the target response, then the iterative process continues.

A further understanding of the nature and advantages of the present invention may be realized by reference to the remaining portions of the specification and the drawings.

DESCRIPTION OF THE SPECIFIC EMBODIMENTS

Figure 1:
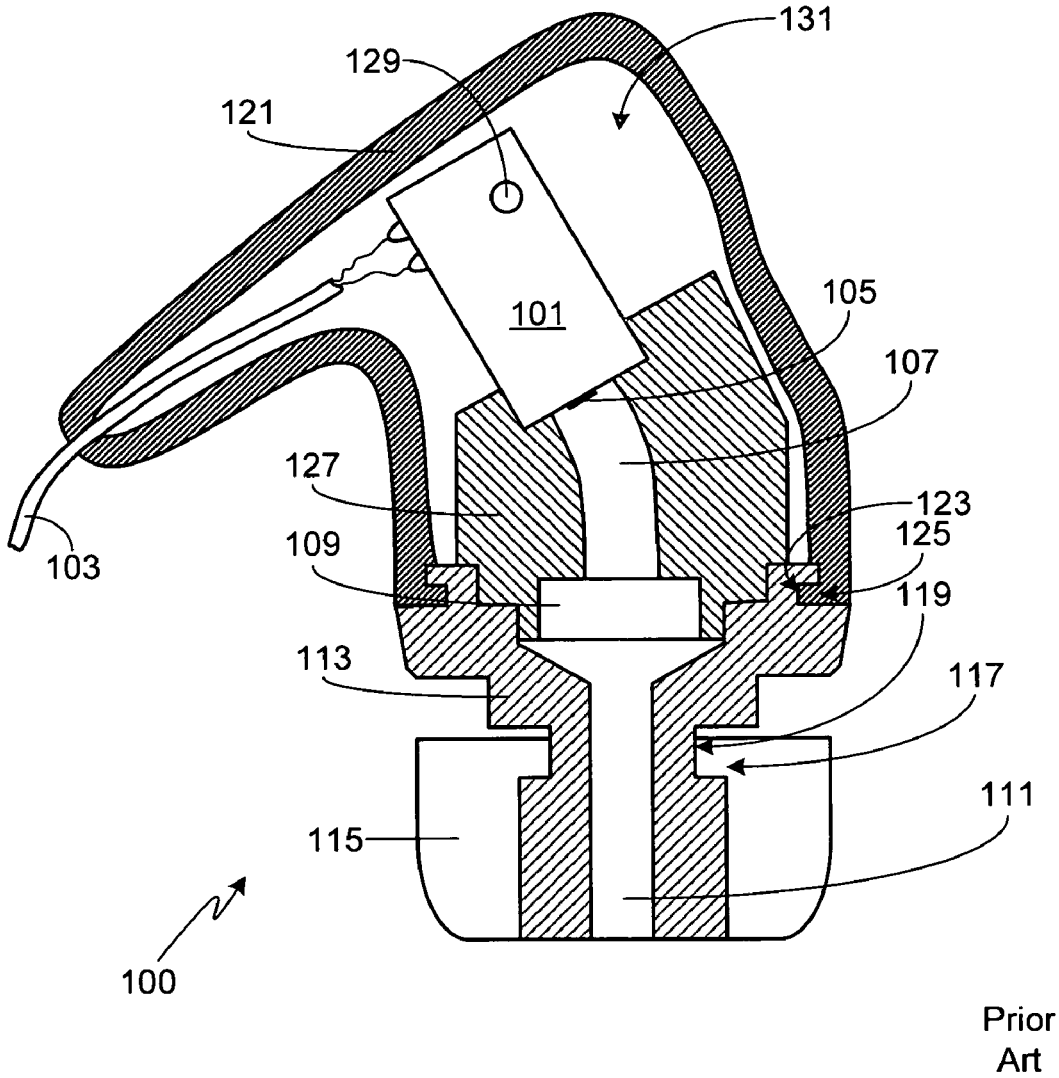
FIG. 1 illustrates an earpiece with a ported driver fabricated in accordance with the prior art.

FIG. 1 is an illustration of a ported earpiece in accordance with the prior art. In this particular configuration earpiece 100, also referred to herein as an in-ear monitor and a canal-phone, includes a single armature driver 101. Driver 101 is coupled to a source, not shown, via cable 103. Only a portion of cable 103 is visible in FIG. 1. The sound that is produced by armature driver 101 exits an output port 105 and passes through a sound delivery tube 107. Although not required by the prior art or the current invention, in some configurations and as shown in the illustrated configuration, the output end of sound tube 107 is coupled to a damper 109, also commonly referred to as an acoustic filter. In addition to providing a means of tuning the frequency response of the earpiece, for example by reducing the output level for a particular frequency range, damper 109 can also be used to reduce the overall sound pressure level. The sound passing through damper 109, or directly from sound tube 107, enters sound delivery tube 111 of sound delivery member 113. At least a portion of sound delivery member 113 is designed to fit within the outer ear canal of the user and as such, is generally cylindrical in shape.

Attached to the end portion of sound delivery member 113 is an eartip 115, also referred to as an eartip sleeve or simply a sleeve. Additionally, and as known by those of skill in the arts, eartip 115 or the combination of sound delivery member 113 and eartip 115 can be replaced with a custom fit eartip (not shown). A custom fit eartip is one that is designed to fit into a particular user's ear. Custom fit eartips, which are left ear and right ear specific, are made by first making a casting of the user's ear canal and concha, and then molding the earpiece from the casting.

Custom fit earpieces typically provide better performance, both in terms of delivered sound fidelity and user comfort, than generic earpieces. Generic earpieces, however, are generally much less expensive as custom molds are not required and the earpieces can be manufactured in volume. In addition to the cost factor, generic earpieces are typically more readily accepted by the general population since many people find it both too time consuming and somewhat unnerving to have to go to a specialist, such as an audiologist, to be fitted for a custom earpiece.

In the illustrated configuration, a generic eartip 115 is shown. Eartip 115 can be fabricated from any of a variety of materials including foam, plastic and silicon based material. Eartip 115 can have the generally cylindrical and smooth shape shown in FIG. 1, or can include one or more flanges. To hold eartip 115 onto member 113 during normal use but still allow the eartip to be replaced when desired, typically the eartip includes a lip portion 117 which is fit into a corresponding channel or groove 119 in sound delivery member 113. The combination of an interlocking groove 119 with a lip 117 provides a convenient means of replacing eartip 115, allowing sleeves of various sizes, colors, materials, material characteristics (density, compressibility), or shape to be easily attached to in-ear monitor 100. As a result, it is easy to provide the end user with a comfortable fit at a fraction of the cost of a custom fit eartip. Additionally, the use of interlocking members 117 and 119 allow worn out eartips to be quickly and easily replaced. It will be appreciated that other eartip mounting methods can be used with earpiece 100. For example, eartip 115 can be attached to sound delivery member 113 using pressure fittings, bonding, etc.

An outer earpiece enclosure 121 attaches to sound delivery member 113. Earpiece enclosure 121 protects driver 101 (or multiple drivers) and any required earpiece circuitry (e.g., cross-over circuit for multiple driver implementation) from damage while providing a convenient means of securing cable 103, or alternately a cable socket (not shown), to the in-ear monitor. Enclosure 121 can be attached to member 113 using interlocking members (e.g., groove 123, lip 125). Alternately, an adhesive or other means can be used to attach enclosure 121 to member 113. Enclosure 121 can be fabricated from any of a variety of materials, thus allowing the designer and/or user to select the material's firmness (i.e., hard to soft), texture, color, etc. Enclosure 121 can either be custom molded or designed with a generic shape.

There are a variety of techniques that can be used to hold, or mount, the components of the earpiece within earpiece enclosure 121. In the illustrated configuration, a boot member 127 is used to hold damper 109, sound tube 107 and a portion of driver 101 in place.

In addition to output port 105, driver 101 includes a secondary port, or vent, 129. Port 129 opens up to sealed region 131, this region defined by the combination of housing 121 and those earpiece components residing within, or coupled to, housing 121 (e.g., driver 101, cable 103, boot member 127 and the end portion of sound delivery member 113). The volume of region 131 defines the acoustic impedance that port 129 is subject to and, consequently, the frequency response of driver 101/earpiece 100. As known by those of skill in the art, since region 131 is used to control the back pressure that the driver is subjected to, the diameter of port 129 must be large relative to output port 105, on the order of at least 25 percent of the cross-sectional area of output port 105 and more typically on the order of at least 100 percent of the cross-sectional area of output port 105. Additionally it is known that the volume of region 131 must be carefully controlled in order to allow the resonant peaks of an earpiece to be controlled. Such control may be used, for example, to improve the low frequency response of the earpiece.

Although sealed region 131 can be used to control the acoustic performance of the earpiece, it will be appreciated that maintaining a specific volume for region 131, especially for a mass produced earpiece, is difficult. During manufacturing, a variety of factors can alter the volume of region 131, thus altering the acoustic performance of the earpiece. For example, if the sealant and/or adhesive used to couple housing 121 to sound delivery member 113 extends into region 131 the volume of the region will be impacted. Similarly, the length of cable 103 that extends into region 131 and the fit of driver 101 within boot member 127 will both affect the volume of the enclosed region. Additionally, tight control of the manufacturing tolerances of the individual components associated with region 131 must be maintained in order to achieve a specific volume and thus the desired acoustic performance.

Figure 2:
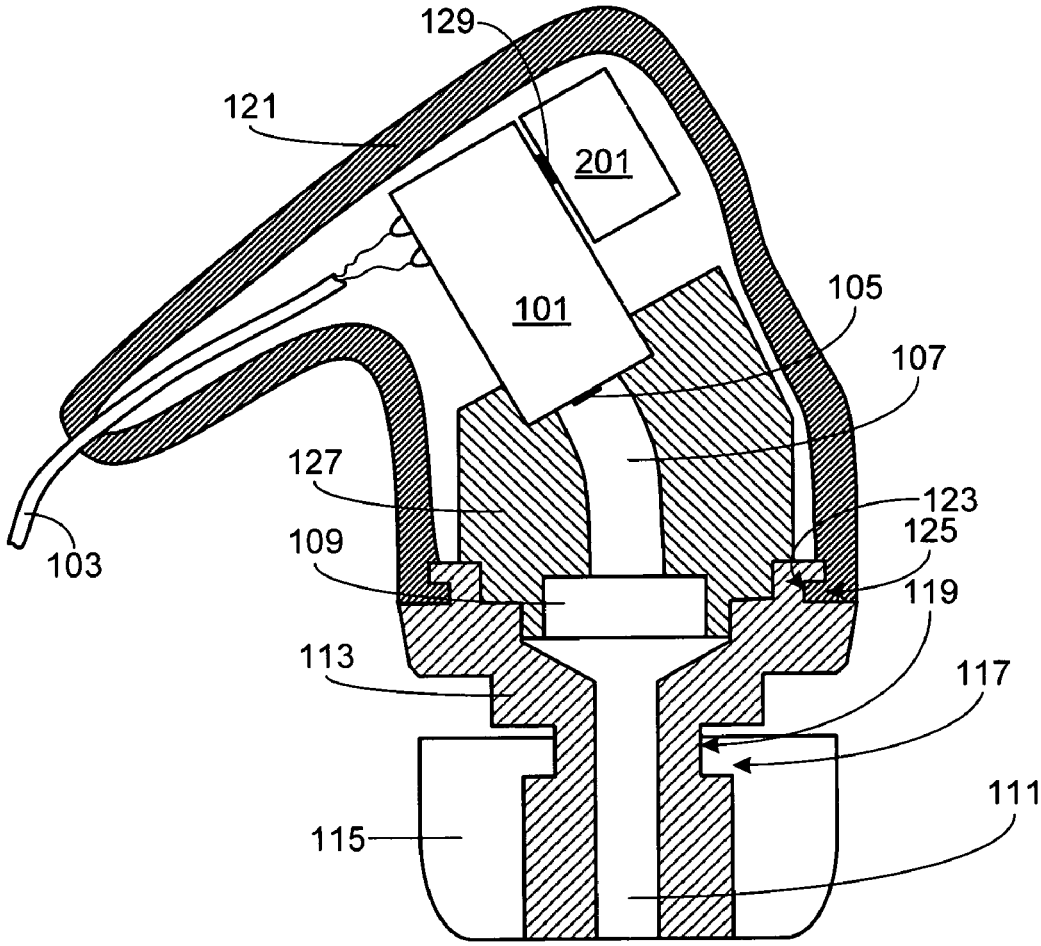
Prior Art FIG. 2
FIG. 2 illustrates a prior art earpiece similar to that shown in FIG. 1, except for the use of a sealed enclosure coupled to the ported driver.

In order to overcome the manufacturing variances that can alter the volume of the region to which port 129 is coupled to and thus better control the acoustic performance of a mass produced earpiece, port 129 can be coupled to a controlled volume chamber 201 within housing 121 as shown in FIG. 2.

Controlled volume chamber 201 can be of any of a variety of shapes. Although the use of chamber 201 makes it easier to vent the driver to a controlled volume that is reproducible in a mass produced earpiece, it will be appreciated that there is little room within an in-ear monitor for inclusion of such a chamber. This is especially true if the earpiece includes multiple drivers. In yet another alternate configuration, port 129 can be coupled to free space, thereby providing an infinite controlled volume. Note that the location of port 129 in FIGS. 1 and 2 has been altered to clarify the figures and is otherwise insignificant.

Figure 3:
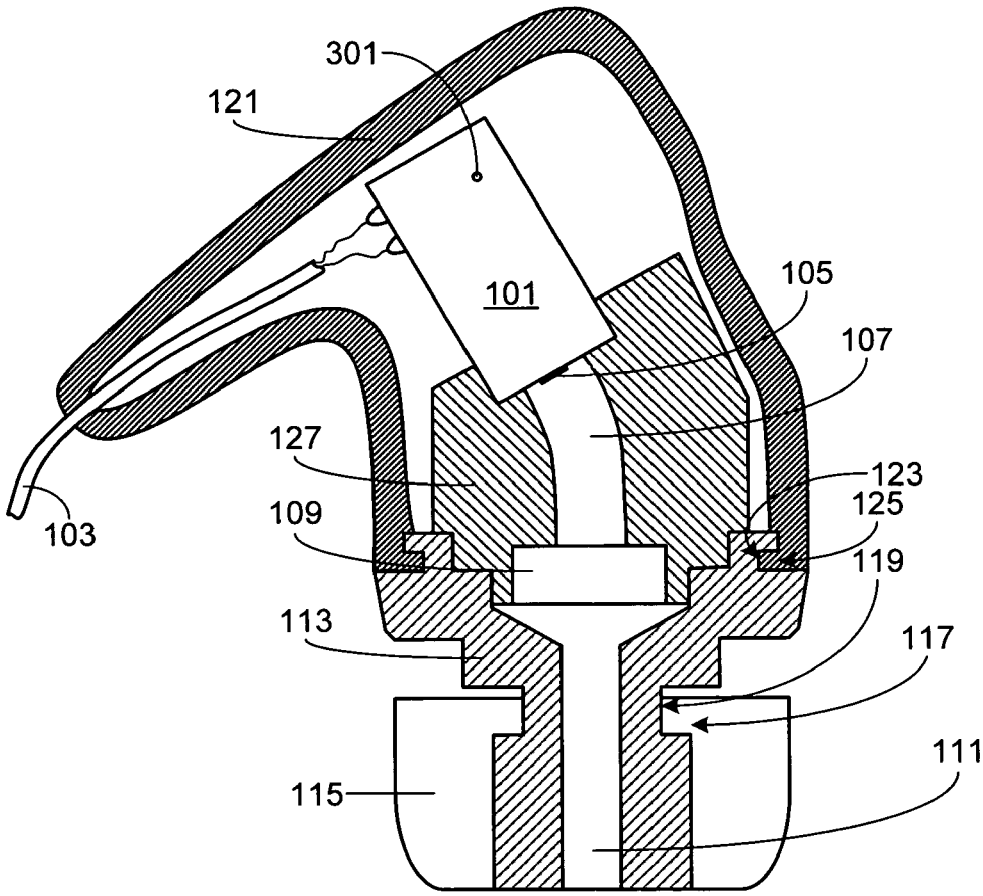
FIG. 3 illustrates an earpiece in which the driver includes a control port in accordance with the invention.

The inventor of the present invention has found that by sufficiently decreasing the diameter of the venting port (e.g., control port 301 shown in FIG. 3), the port itself controls the acoustic performance of the driver and thus the earpiece. It will be appreciated that control port 301 must be sufficiently small to restrict the flow of air into and out of driver 101, otherwise the volume of the region within the enclosure will continue to affect the acoustic performance of the earpiece. The exact size of the control port is selected to achieve the desired acoustic performance, typically optimizing low frequency sound by controlling driver resonant peaks. In all cases, control port 301 is less than 25 percent of the cross-sectional area of output port 105. In at least one preferred embodiment of the invention, control port 301 has a diameter of approximately 0.20 millimeters, preferably with a tolerance of ±0.03 millimeters.

It will be appreciated by those of skill in the art that the use of a control venting port (e.g., port 301) dramatically eases the manufacturing tolerances placed on the earpiece as the volume within enclosure 121 need no longer be carefully controlled from earpiece to earpiece in order to achieve the desired acoustic performance. Additionally, if the enclosure is leaky, i.e., not completely sealed, the acoustic performance will not be affected, as the volume within the region is not being used to control the driver resonant peaks.

Figure 4:
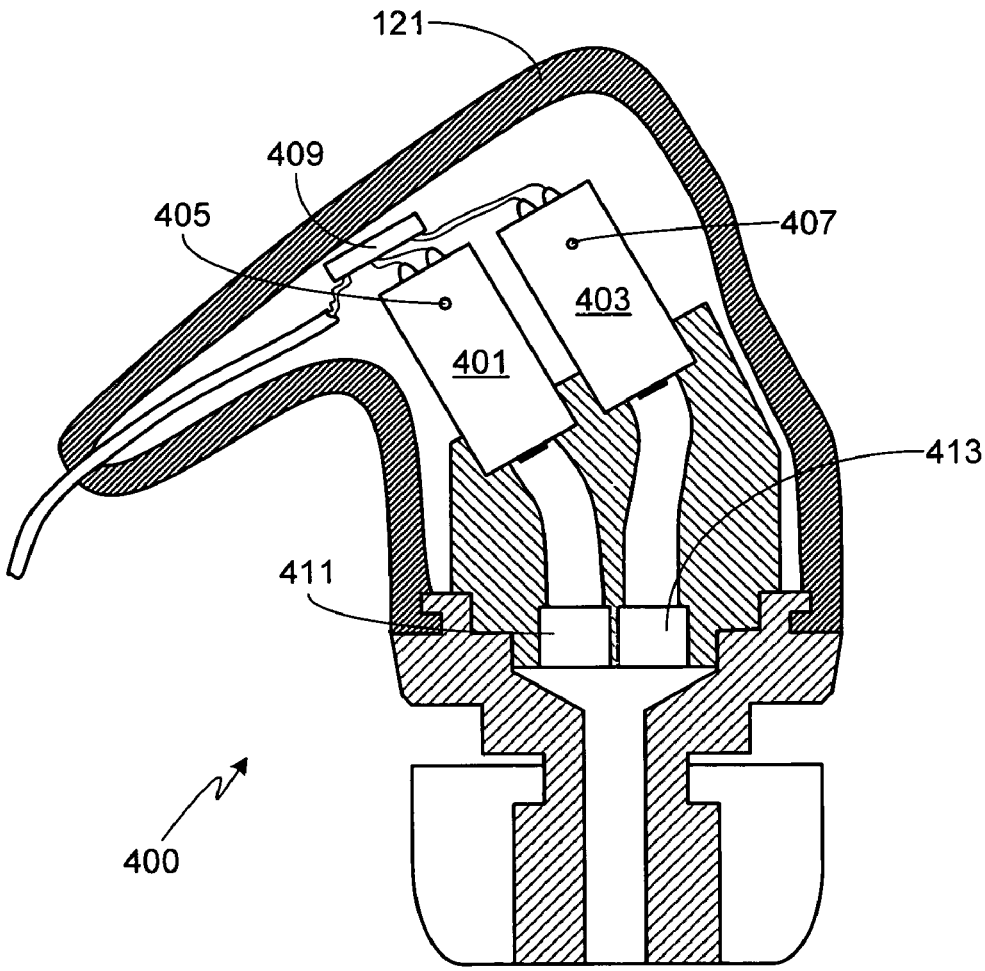
FIG. 4 illustrates an earpiece utilizing a pair of armature drivers, each of which includes a control port.
Figure 5:
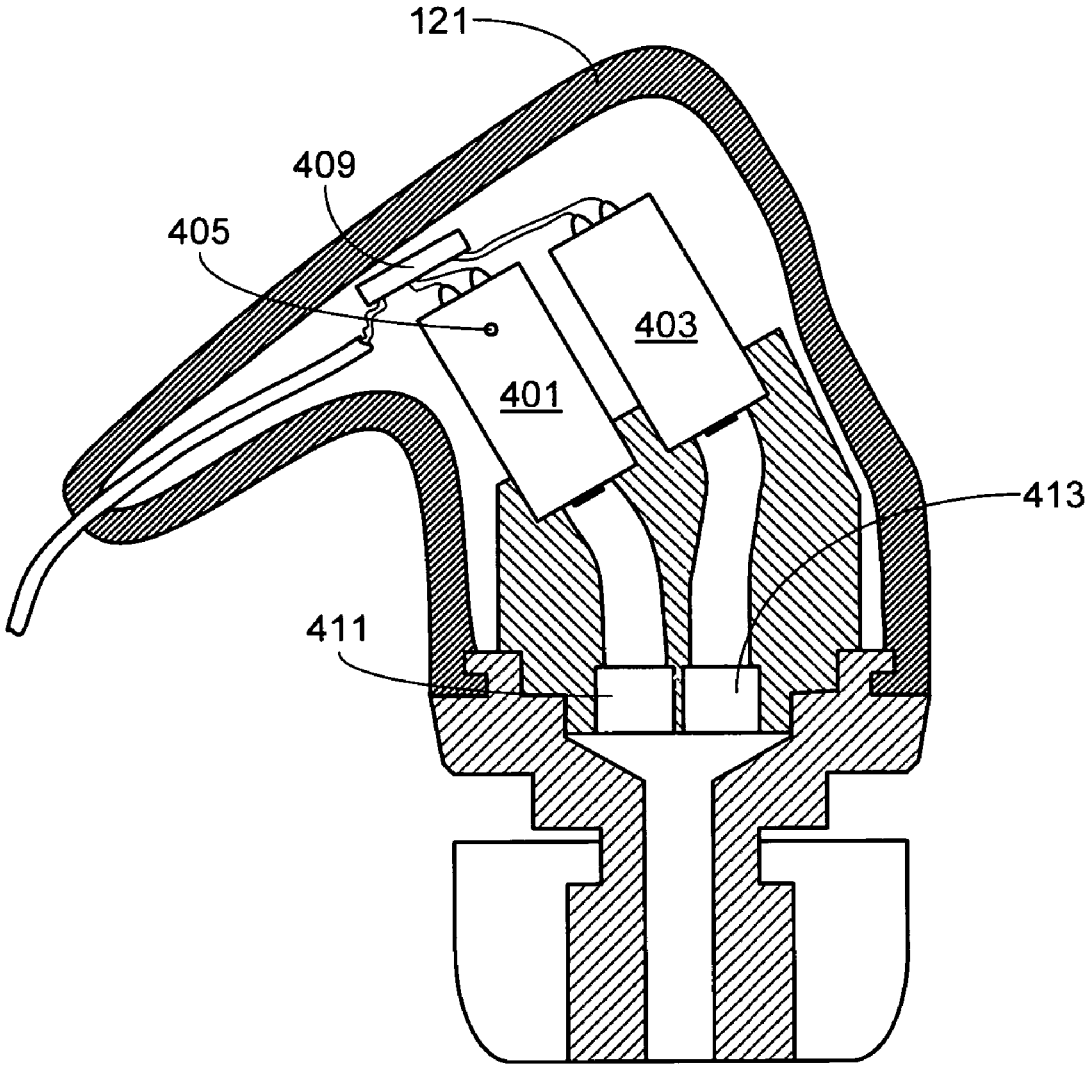
FIG. 5 illustrates an earpiece similar to that shown in FIG. 4, except that only one of the drivers includes a control port.

In addition to easing the manufacturing process, the use of a control port as disclosed by this invention also simplifies venting the individual drivers of a multi-driver earpiece. Utilizing the invention, some or all of the drivers in the multi-driver earpiece may be vented. For example, FIG. 4 illustrates an earpiece 400 that includes a pair of drivers 401/403. Drivers 401/403 include control ports 405/407, respectively. Although not part of the invention, FIG. 4 also shows a circuit 409, preferably comprised of a passive crossover circuit. The passive crossover circuit divides the incoming audio signal into a low-frequency portion electrically routed to driver 401 and a high-frequency portion electrically routed to driver 403. Each driver may or may not include an acoustic filter (i.e., a damper). In the illustrated embodiment a first damper 411 is acoustically coupled to driver 401 and a second damper 413 is acoustically coupled to driver 403. For the sake of clarity, FIG. 5 illustrates an earpiece identical to that shown in FIG. 4 except that only one of the drivers, i.e., driver 401, includes a control port. This approach can be used, for example, to alter only the frequency response of the driver being used to drive the lower frequencies, thus providing an effective means of further increasing the base response of the earpiece.

Figure 6:
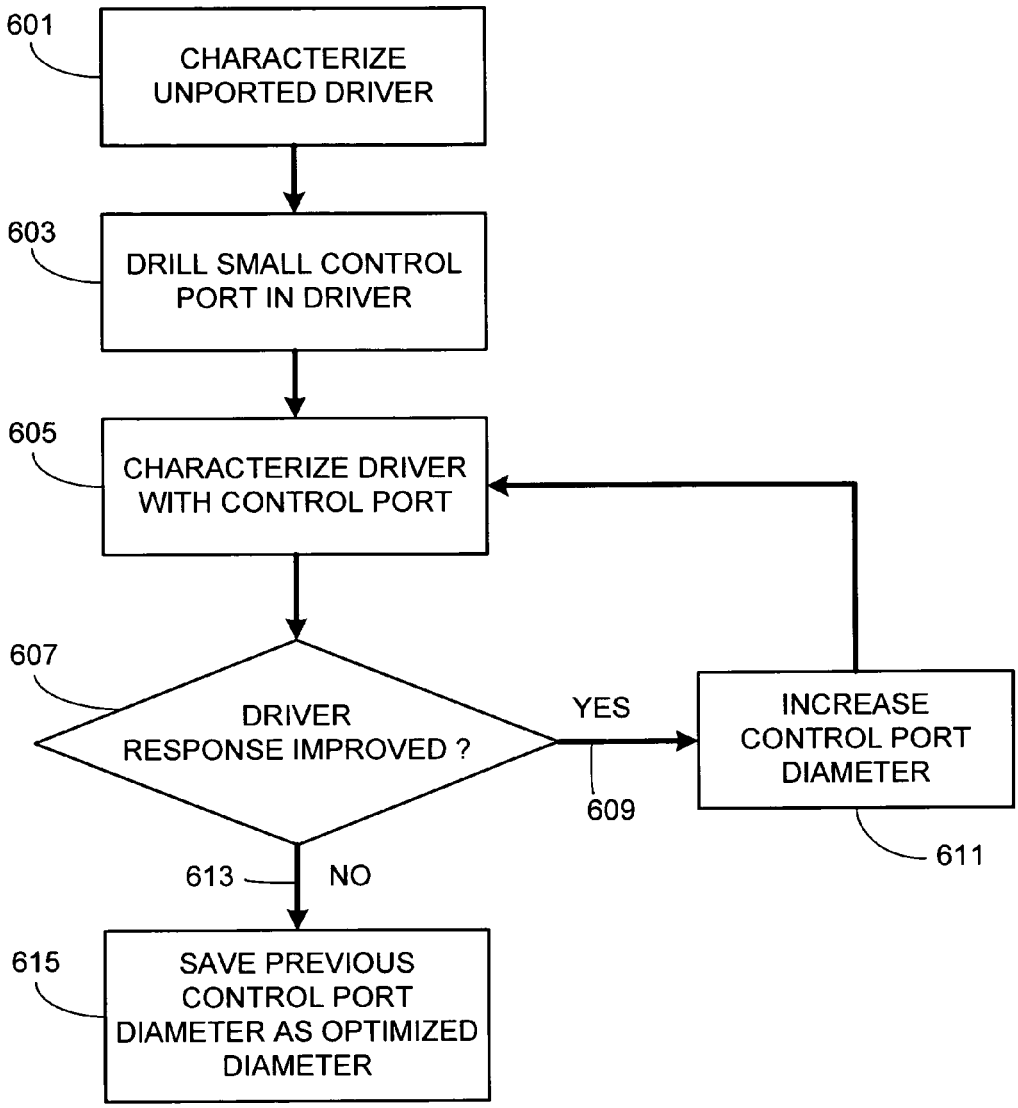
FIG. 6 illustrates an optimization process used to determine the optimal control port diameter for a particular driver configuration and desired driver response.

Although the inventor has found that in a variety of earpiece configurations a control port with a diameter of approximately 0.20 millimeters is appropriate, when control port size optimization is required, for example during the design of a new earpiece configuration, the optimization process described below and illustrated in FIG. 6 is preferred. The illustrated process can be performed to a driver that is either separate from, or integrated within, an earpiece. The first step (step 601) is to characterize the driver (or drivers) frequency response for the new earpiece. Once characterized, a small control port is bored (e.g., drilled) into the driver (step 603). Typically, the diameter of this port should be as small as possible utilizing conventional fabrication techniques. Preferably the initial port diameter is less than 0.10 millimeters, more preferably less than 0.05 millimeters, and even more preferably approximately 0.01 millimeters. After the initial control port has been drilled into the driver, the driver and/or earpiece assembly is re-characterized (step 605). The response of the driver as well as the previously characterized driver response are then compared to a target response (step 607). The target response is the desired response for the particular driver configuration, for example, one in which the low frequency response is extended, a resonant peak is controlled, etc. If the response is improved (step 609), the diameter of the control port is increased by a pre-selected, and relatively small, amount (step 611). Preferably the diameter of the control port is increased by at least 0.02 millimeters, and more preferably by approximately 0.01 millimeters. The driver is then re-characterized (step 605) and the new response as well as the previous response are then compared to the target response (step 607). This iterative process continues until a new response is worse than the previous response (step 613). At this point the previous control port diameter is selected as the optimal diameter for this particular configuration and the desired target response (step 615).

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. An earpiece comprising:

an earpiece enclosure;

a driver disposed within said earpiece enclosure, said driver comprising:

an output port; and a control port, wherein a cross-sectional area of said control port is less than 25 percent of a cross-sectional area of said output port, wherein said cross-sectional area of said control port is sufficiently small to restrict air flow into and out of said driver during operation, and wherein said cross-sectional area of said control port controls an acoustic performance corresponding to said driver without the use of an acoustic filter corresponding to said control port and irrespective of a volume corresponding to said earpiece enclosure;

an eartip acoustically coupled to said output port of said driver, wherein said eartip is separate from said earpiece enclosure; and means for mounting said eartip to said earpiece enclosure.

2. The earpiece of claim 1, wherein said driver is an armature driver.

3. The earpiece of claim 1, wherein said earpiece enclosure is of a generic shape.

4. The earpiece of claim 1, wherein said earpiece enclosure is a custom molded enclosure.

5. The earpiece of claim 1, wherein said eartip is fabricated from a material selected from the group consisting of foam, plastic, and silicon-based material.

6. The earpiece of claim 1, wherein said means for mounting said eartip to said earpiece enclosure is comprised of an earpiece enclosure interlocking member and an eartip interlocking member.

7. An earpiece comprising:

an earpiece enclosure;

a driver disposed within said earpiece enclosure, said driver comprising:

an output port; and a control port with a diameter of approximately 0.20 millimeters, wherein a cross-sectional area of said control port is sufficiently small to restrict air flow into and out of said at least one driver during operation, and wherein said cross-sectional area of said control port controls an acoustic performance corresponding to said driver without the use of an acoustic filter corresponding to said control port and irrespective of a volume corresponding to said earpiece enclosure;

an eartip acoustically coupled to said output port of said driver, wherein said eartip is separate from said earpiece enclosure; and means for mounting said eartip to said earpiece enclosure.

8. The earpiece of claim 7, wherein said driver is an armature driver.

9. The earpiece of claim 7, wherein said earpiece enclosure is of a generic shape.

10. The earpiece of claim 7, wherein said earpiece enclosure is a custom molded enclosure.

11. The earpiece of claim 7, wherein said eartip is fabricated from a material selected from the group consisting of foam, plastic, and silicon-based material.

12. The earpiece of claim 7, wherein said means for mounting said eartip to said earpiece enclosure is comprised of an earpiece enclosure interlocking member and an eartip interlocking member.

13. An earpiece comprising:

an earpiece enclosure;

a first driver disposed within said earpiece enclosure, said first driver comprising:

a first output port; and a first control port, wherein a cross-sectional area of said first control port is less than 25 percent of a cross-sectional area of said first output port, wherein said cross-sectional area of said first control port is sufficiently small to restrict air flow into and out of said first driver during operation, and wherein said cross-sectional area of said first control port controls an acoustic performance corresponding to said first driver without the use of any acoustic filters corresponding to said first control port and irrespective of a volume corresponding to said earpiece enclosure;

a second driver disposed within said earpiece enclosure, said second driver comprising:

a second output port; and a second control port, wherein a cross-sectional area of said second control port is less than 25 percent of a cross-sectional area of said second output port, wherein said cross-sectional area of said second control port is sufficiently small to restrict air flow into and out of said second driver during operation, and wherein said cross-sectional area of said second control port controls an acoustic performance corresponding to said second driver without the use of any acoustic filters corresponding to said second control port and irrespective of said volume corresponding to said earpiece enclosure;

an eartip acoustically coupled to said first output port of said first driver and said second output port of said second driver, wherein said eartip is separate from said earpiece enclosure; and means for mounting said eartip to said earpiece enclosure.

14. The earpiece of claim 13, wherein said first driver is an armature driver.

15. The earpiece of claim 13, wherein said second driver is an armature driver.

16. The earpiece of claim 13, wherein said earpiece enclosure is of a generic shape.

17. The earpiece of claim 13, wherein said earpiece enclosure is a custom molded enclosure.

18. The earpiece of claim 13, wherein said eartip is fabricated from a material selected from the group consisting of foam, plastic, and silicon-based material.

19. The earpiece of claim 13, wherein said means for mounting said eartip to said earpiece enclosure is comprised of an earpiece enclosure interlocking member and an eartip interlocking member.

* * * * *